US005341617A

United States Patent [19]

Thomas et al.

[11] Patent Number: 5,341,617

[45] Date of Patent: Aug. 30, 1994

[54] ROOF TILE FASTENING ARRANGEMENT

[75] Inventors: John F. Thomas, Villa Park, Calif.; Paul S. Hensey, Horsham, United Kingdom

[73] Assignee: Monier Roof Tile Inc., Orange, Calif.

[21] Appl. No.: 76,909

[22] Filed: Jun. 15, 1993

Related U.S. Application Data

[63] Continuation-in-part of Ser. No. 964,729, Oct. 22, 1992.

[51] Int. Cl.[5] ..... E04D 1/34

[52] U.S. Cl. ..... 52/547; 52/94; 52/489.1; 52/549; 52/550; 52/551; 52/714

[58] Field of Search ..... 52/714, DIG. 15, 94, 52/95, 489, 506, 547, 549, 550, 551

[56] References Cited

U.S. PATENT DOCUMENTS

| | | | |
|---|---|---|---|
| 2,849,756 | 9/1958 | Gundel et al. | 52/714 |
| 4,096,671 | 6/1978 | Aarons | 52/94 |
| 4,106,253 | 8/1978 | Aarons | 52/547 |
| 4,141,191 | 2/1979 | Aarons | 52/547 |
| 4,182,090 | 1/1980 | Aarons | 52/489 |
| 4,314,433 | 2/1982 | Hulcombe | 52/547 |
| 5,077,952 | 1/1992 | Moore . | |

FOREIGN PATENT DOCUMENTS

| | | | |
|---|---|---|---|
| 489499 | 6/1992 | European Pat. Off. | 52/489 |
| 1709312 | 2/1973 | Fed. Rep. of Germany | 52/547 |

*Primary Examiner*—Carl D. Friedman
*Assistant Examiner*—Christopher Todd Kent
*Attorney, Agent, or Firm*—Spensley Horn Jubas & Lubitz

[57] ABSTRACT

A roof tile fastening arrangement secures each of a plurality of concrete roof tiles, disposed in side-by-side relation, to a birdstop mounted adjacent the lower edge of a roof support structure, by a plurality of clips extending between and secured to the side edges of the tiles and to the birdstop. Each of the clips has an upper curved lip portion extending over the side edge of an associated one of the tiles. In a first embodiment, each of the clips has a lower hook portion which hooks to a different one of a plurality of drain slots adjacent the base of the birdstop. The clip is made of resilient material and has a curved body portion which may be flexed to facilitate installation of the clip and which then assumes the curved configuration to hold the clip in tension between the side edge of the associated tile and the associated drain slot in the birdstop. The clip is of thin, planar configuration and is twisted so that the upper curved lip portion forms an essentially right angle relationship with the intermediate portion. In a second embodiment, each of the clips has a body portion extending through and secured within a different one of a plurality of apertures in the birdstop. The body portion extends through a reverse curve and has a plurality of notches in a surface thereof to facilitate engagement in the aperture within the birdstop. The body portion is of generally round cross-sectional configuration and the upper curved lip portion is of generally flat, planar cross-sectional configuration. In a third embodiment, each clip is made of resilient material and has a curved body portion terminating in a lower clasp portion which resiliently locks within a rectangular aperture in the birdstop. The lower clasp portion has a base disposed against one side of the birdstop and resilient upper and lower lip portions disposed against an opposite side of the birdstop.

7 Claims, 6 Drawing Sheets

ROOF TILE FASTENING ARRANGEMENT

CROSS-REFERENCE TO RELATED APPLICATION

This application is a continuation-in-part of pending application Ser. No. 07/964,729 of John F. Thomas, filed Oct. 22, 1992 and entitled ROOF TILE FASTENING ARRANGEMENT.

BACKGROUND OF THE INVENTION

1. Field of the Invention

The present invention relates to roof tile fastening arrangements in which clips are used to help secure concrete roof tiles in place on a roof support structure.

2. History of the Prior Art

Certain roof tiles such as concrete roof tiles are typically mounted on a roof support structure by securing them directly to the solid deck of the roof support structure or to battens mounted in spaced-apart fashion on the solid deck. For example, such tiles may be provided with a nail hole adjacent an upper edge thereof so that a nail can be driven through the hole and into the underlying solid deck or batten to secure the tile in place. The tiles are installed in overlapping fashion. Upon installation of each tile by driving a nail through the nail hole thereof, the next tile thereabove is installed so that the lower edge thereof covers the upper edge including the nail and nail hole of the tile. At the same time, the opposite side edges of each tile overlap with the side edges of adjacent tiles to provide a continuous roofing configuration.

In roof configurations of the type described, the lowest row or course of tiles is typically mounted on a facia member such as a birdstop which is mounted at the lower edge of the underlying roof support structure and which supports the lowest course of tiles at an appropriate angle. The birdstop covers the spaces between the lowest course of tiles and the underlying roof support structure to keep out birds, insects, debris and the like. Typically, small slots are provided in the birdstop adjacent the base thereof so that any moisture accumulating beneath the tiles can drain therethrough.

It is frequently desirable to secure the concrete roof tiles to the roof support structure using more than just the nails driven into the nail holes in the tiles. Regions which experience high winds, for example, will usually dictate that additional securing means be used, particularly at the lowest course of tiles at the edge of the roof where the forces tending to lift the tiles from the underlying roof support structure are greatest.

One common approach to providing additional securing of the roof tiles to the roof support structure involves the use of roof tile clips. Typically, such clips attach to the underlying roof support structure and extend over the side edges of the tiles to assist in securing the tiles in place and in preventing strong winds from lifting the tiles. Each tile is secured with a separate clip that is mounted on the roof support structure. The clips extend upwardly from the roof support structure and terminate in curved upper ends which extend over and engage the side edge of associated tiles. Each clip is installed in place after the associated tile is secured to the roof support structure. The next adjacent tile is then secured in place so that the side edge thereof covers the side edge of the tile including the clip.

An example of a roof system using clips to secure the concrete roof tiles is provided by U.S. Pat. No. 5,077,952, which patent issued Jan. 7, 1992 to Peter J. Moore and is commonly assigned with the present application. The roof tile clips described in the Moore patent have an elongated body portion terminating in a lower base portion which is nailed, screwed or otherwise fastened to the underlying roof support structure. A lip portion at an opposite upper end of the clip extends over and engages a side edge of the roof tile. The lip portion is inclined relative to the body portion by an amount approximately equal to the amount of inclination of the roof tile relative to the underlying roof support structure to provide a close, relatively conforming fit of the lip portion with the side edge of the roof tile. The lip portion is further configured to provide a conforming fit over a ridge at the roof tile's side edge, and includes a neck portion at an acute angle to the body portion so as to fit flat against an angled flat surface at the side of the roof tiles, an intermediate portion extending from the neck portion and a terminal portion extending from the intermediate portion. The intermediate and terminal portions extend over and around and are configured to conform to the shape of the ridge and adjacent recessed configuration of the side edge of the roof tile.

Roof tile clips of the type shown and described in the Moore patent have been found to be effective in securing concrete roof tiles in place. However, such clips involve a considerable amount of labor in the process of installing the roof. Each such clip must be secured to the underlying roof support structure by nailing, screwing or otherwise fastening the base portion thereof. In view of this, it would be desirable to provide tile clipping arrangements in which the clips can easily be installed with a simple motion and without the need to nail, screw or otherwise secure the clip to the roof support structure.

SUMMARY OF THE INVENTION

The foregoing and other objects are accomplished by improved roof tile fastening arrangements in accordance with the invention. In such arrangements, each clip is secured between the side edge of an associated roof tile and a facia member such as a birdstop mounted on the roof support structure adjacent the lower edge of the support structure. Each clip extends between and is coupled to the birdstop or other facia member and to one of a pair of opposite side edges of an associated one of a plurality of tiles. Each of the clips has an upper curved lip portion extending over the side edge of the associated tile.

In a first embodiment of a roof tile fastening arrangement in accordance with the invention, each of the clips is provided with a lower hooked portion for hooking to a different one of a plurality of drain slots adjacent a base of the birdstop. Each clip has a curved body portion above the lower hook portion and is made of resilient material to hold the clip in tension between the side edge of the associated tile and the drain slot in which the lower hook portion is hooked. After hooking the upper curved lip portion over the side edge of the tile, the resilient clip is pushed against the birdstop. This straightens the curved body portion enough to seat the lower hook portion within the drain slot in the birdstop. Upon release of the clip, the resilient material thereof holds the clip in tension between the side edge of the tile and the drain slot in the birdstop. The clip is of thin, planar configuration and is twisted so that the upper curved lip portion forms an essentially right angle relationship with the intermediate body portion. The upper curved lip portion has a neck portion extending upwardly from the intermediate body portion, an intermediate portion extending laterally from the neck portion and a terminal portion extending downwardly from the intermediate portion.

In a second embodiment of a roof tile fastening arrangement in accordance with the invention, the birdstop is provided with a plurality of apertures therein and each of the clips has a body portion extending through and secured within a different one of the plurality of apertures in the birdstop. The body portion of each of the clips is curved and has a plurality of notches in a surface thereof to frictionally secure the body portion within the associated one of the apertures in the birdstop. Installation of the clip is accomplished by inserting the body portion thereof into the aperture in the birdstop as the upper curved lip portion of the clip is seated over the side edge of the associated tile. A downward pushing motion on the tile and the clip latches the body portion of the clip within the aperture in the birdstop with the aid of the notches in the surface of the body portion. The body portion of the clip extends through a reverse curve and is of generally round cross-sectional configuration. The upper curved lip portion is of generally flat, planar cross-sectional configuration, and has a neck portion extending upwardly from the intermediate body portion, an intermediate portion extending laterally from the neck portion, and a terminal portion extending downwardly from the intermediate portion.

In a third embodiment of a roof tile fastening arrangement in accordance with the invention, each clip is provided with a lower clasp portion for resiliently locking disposition within one of a plurality of rectangular apertures in the birdstop. Each clip has a curved body portion above the lower clasp portion and is made of resilient material to hold the clip in tension between the side edge of the associated tile and the rectangular aperture in the birdstop in which the lower clasp portion is locked. The lower clasp portion has opposite upper and lower resilient lips. After hooking the lower resilient lip over the bottom edge of the rectangular aperture in the birdstop, the clip is rotated upwardly so as to force the upper resilient lip past the upper edge of the rectangular aperture until the lower clasp portion of the clip is seated in resiliently locked fashion within the rectangular aperture. The resilient nature of the curved body portion of the clip permits further upward rotation of the clip in order to seat an upper curved lip portion of the clip over the side edge of the tile. Upon release of the clip, the resilient material thereof holds the clip in tension between the side edge of the tile and the rectangular aperture in the birdstop. The upper curved lip portion has a neck portion extending upwardly from the intermediate body portion, an intermediate portion extending laterally from the neck portion and a terminal portion extending downwardly from the intermediate portion.

BRIEF DESCRIPTION OF THE DRAWINGS

A better understanding of the invention may be had by reference to the following specification in conjunction with the accompanying drawings, in which.

DETAILED DESCRIPTION

Figure 1:
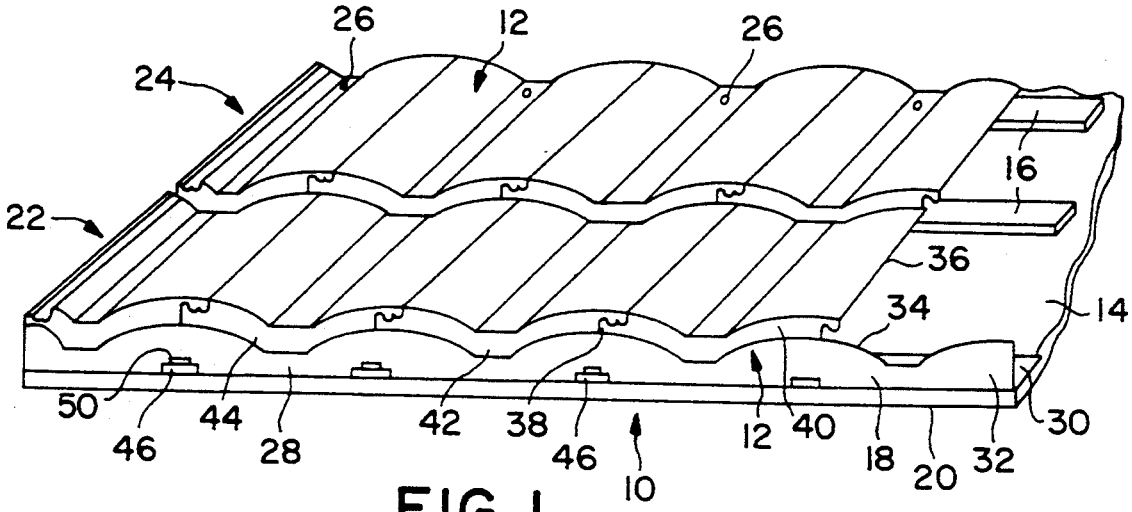
FIG. 1 is a perspective view of a roof configuration including several concrete roof tiles and illustrating a first embodiment of a roof tile fastening arrangement in accordance with the invention.

FIG. 1 depicts a roof configuration 10 utilizing a plurality of concrete roof tiles 12. The roof configuration 10 includes a flat roof support structure 14 which may be comprised of a sheet of plywood with a thin sheet of water barrier material such as tarpaper disposed over the top thereof to form a deck. The roof support structure 14 also includes a plurality of battens 16. The battens 16 are mounted in spaced-apart, generally parallel fashion together with a facia member 18 which extends across a lower edge 20 of the roof support structure 14. The roof support structure 14 is typically supported by eaves (not shown in FIG. 1).

The roof tiles 12 are mounted on the roof support structure 14 in overlapping fashion. The roof tiles 12 are mounted on the roof support structure 14 in different rows or courses, with each course extending between a different pair of the battens, with the exception of the lowest course which extends between the lowest batten 16 and the facia member 18. Thus, as shown in FIG. 1, the lowest course 22 of the roof tiles 12 extends between and is supported by the facia member 18 and the lower batten 16. A next higher course 24 of the roof tiles 12 has lower portions thereof which overlap the upper portions of the lowest course 22. Each of the roof tiles 12 is provided with at least one nail hole 26. Nails are driven through the nail holes 26 and into the underlying battens 16 to secure the roof tiles 12 in place.

During installation of the roof tiles, the lowest course 22 is installed first. In the present example, the facia member 18 comprises a metal birdstop 28 which is mounted on the roof support structure 14 at the lower edge 20 thereof. The birdstop 28 comprises an integral piece of metal which is bent so as to have a base portion 30 for mounting on the roof support structure 14 using screws or other appropriate fasteners and an upright portion 32 which extends upwardly from the base portion 30 at an approximate right angle thereto. The upright portion 32 has a scalloped upper edge 34 which conforms to the non-flat contours of the roof tiles 12. Where the tiles are flat instead of profiled and with undulating cross-sectional shapes as shown and described herein, the upper edge of the birdstop is straight and is parallel to the base thereof. With the lower edge of the lowest course 22 of roof tiles 12 supported by the upright portion 32 of the birdstop 28, the opposite upper edges of such tiles are nailed to the batten 16 therebelow. Each of the roof tiles 12 within the lowest course 22 is secured by clips during the installation of such lowest course 22, in a manner described in detail hereafter.

Following installation of the lowest course 22, the next higher course 24 of the roof tiles 12 is installed. This is accomplished by placing the roof tiles 12 of the next higher course 24 so that the lower edges thereof overlap the upper edges of the tiles of the lowest course 22 and the opposite upper edges thereof are disposed over an underlying batten 16. Nails are then driven into the nail holes 26 at the upper edges of such roof tiles 12. Following that, the next higher course of the roof tiles 12 is installed in the same manner, and so on until the roof is completely installed.

As shown in FIG. 1, each of the roof tiles 12 has an opposite pair of side edges which include a right side edge 36 and a left side edge 38. The roof tiles 12 are installed in side-by-side fashion so that the side edges 36 and 38 thereof overlap or are overlapped by the side edges of adjacent tiles. Because the right side edge 36 of each roof tile 12 overlaps the left side edge 38 of an adjacent one of the roof tiles 12 to the right thereof, installation proceeds from right to left as viewed in FIG. 1. Thus, within the lowest course 22 of the roof tiles 12, a first tile 40 is installed over the birdstop 28 and the batten 16. Then a second tile 42 to the immediate left of the first tile 40 is installed. Following that a third tile 44 to the immediate left of the second tile 42 is installed, and so on.

As shown in FIG. 1, the birdstop 28 is provided with a series of spaced-apart drain slots 46 within the upright portion 32 just above the base portion 30. The drain slots 46 provide for the drainage of any moisture which may accumulate between the roof tiles 12 and the roof support structure 14.

FIGS. 2–5 illustrate a clip 50 used in the first embodiment of a fastening arrangement in accordance with the invention. Such fastening arrangement includes the separate clips 50 for coupling each of the roof tiles 12 within the lowest course 22 to the birdstop 28. Each clip 50 has an upper curved lip portion 52 which extends over and engages the left side edge 38 of an associated one of the roof tiles 12. Each clip 50 also has a lower hook portion 54 which engages a different one of the plurality of drain slots 46 within the birdstop 28. Hooking of the lower hook portion 54 to the drain slot 46 is facilitated by a curved body portion 56 of the clip 50 intermediate the lower hook portion 54 and the upper curved lip portion 52.

The curved body portion 56 of each clip 50 facilitates installation of the clip 50. The clip 50 is preferably made of resilient material. After the upper curved lip portion 52 is seated over the left side edge 38 of the associated roof tile 12, and the lower hook portion 54 is disposed against the upright portion 32 of the birdstop 28, the installer pushes the curved body portion 56 of the resilient clip 50 toward the upright portion 32 of the birdstop 28. This flattens the curved body portion 56 enough so that the lower hook portion 54 enters the drain slot and hooks thereon. The curved body portion 56 is then released, whereupon the resilient nature of the clip 50 holds such clip in tension between the left side edge 38 of the roof tile 12 and the drain slot 46 of the birdstop 28.

Because of the clips 50 being in tension, an upward force is exerted on the birdstop 28 at the drain slots 46 thereof. For this reason, the base portion 30 of the birdstop 28 is preferably secured to the roof support structure 14 by screws 58 or other fasteners disposed adjacent the drain slots 46.

Figure 2:
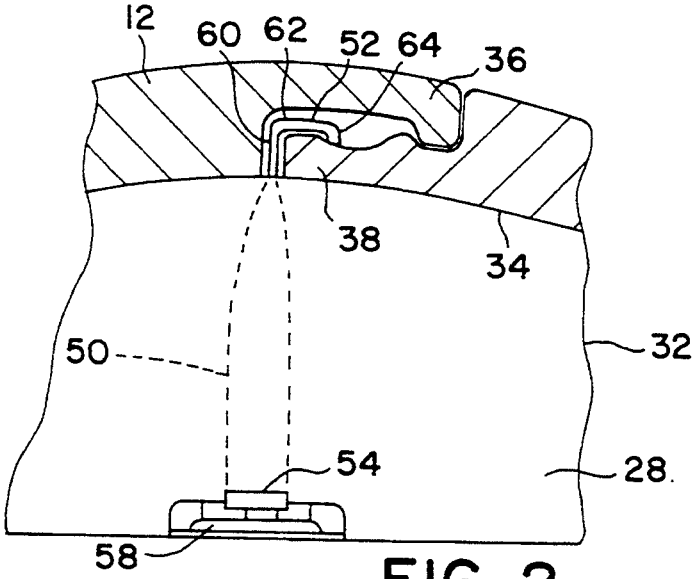
FIG. 2 is a front view of a portion of the roof configuration of FIG. 1 showing the manner in which a clip is used to couple a side edge of a tile to a drain slot in the birdstop of the roof configuration of FIG. 1.
Figure 3:
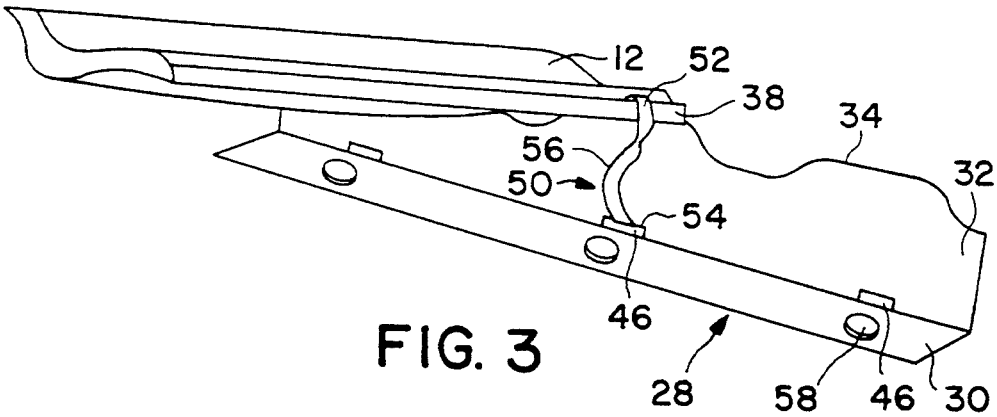
FIG. 3 is a perspective view of the clip of FIG. 2 further illustrating the manner in which it couples the side edge of the tile to a drain slot in the birdstop.
Figure 4:
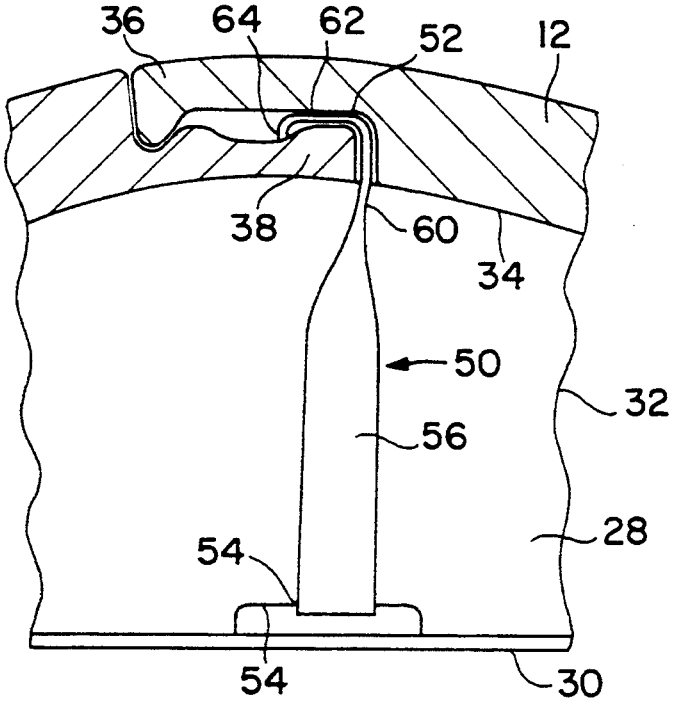
FIG. 4 is a rear view of the embodiment of FIG. 1 opposite the front view of FIG. 2.
Figure 5:
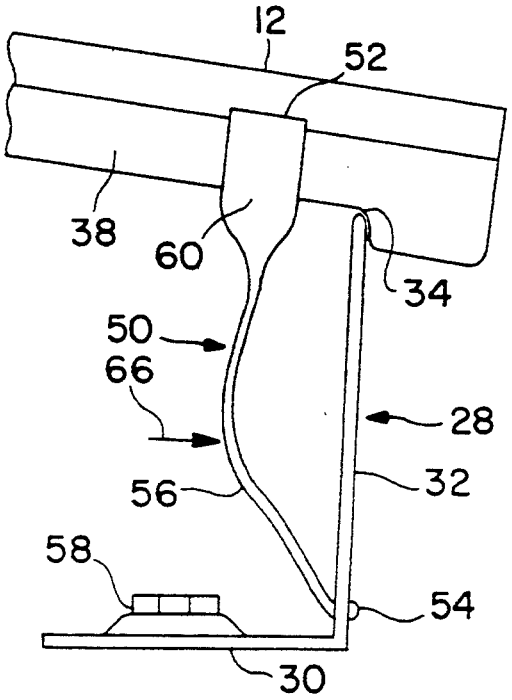
FIG. 5 is a side view of the embodiment of FIG. 1.
Figure 6:
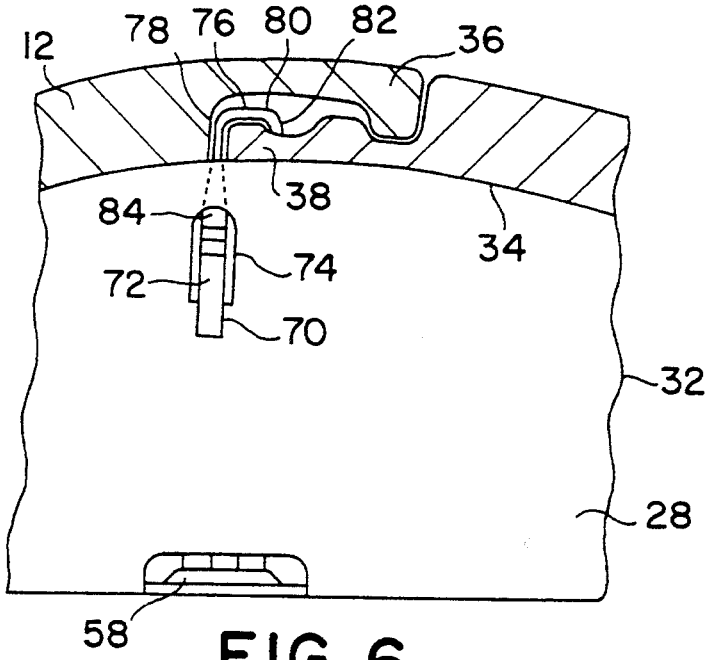
FIG. 6 is a front view of a portion of the roof configuration of FIG. 1 showing a second embodiment in accordance with the invention in which the clips have body portions secured within apertures in the birdstop of the roof configuration of FIG. 1.
Figure 7:
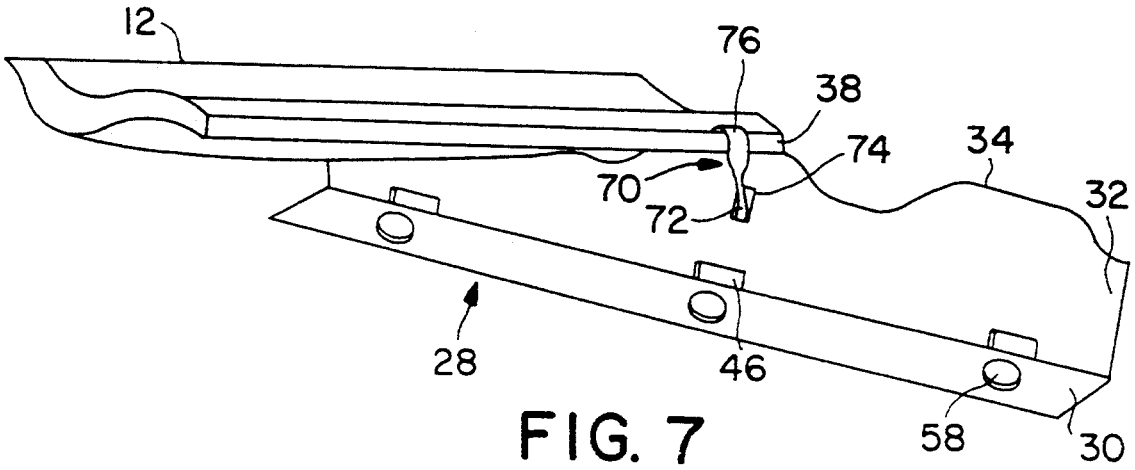
FIG. 7 is a perspective view similar to that of FIG. 3 and showing the manner in which a clip engaging the side edge of the tile is secured to the birdstop in accordance with the embodiment of FIG. 6.
Figure 8:
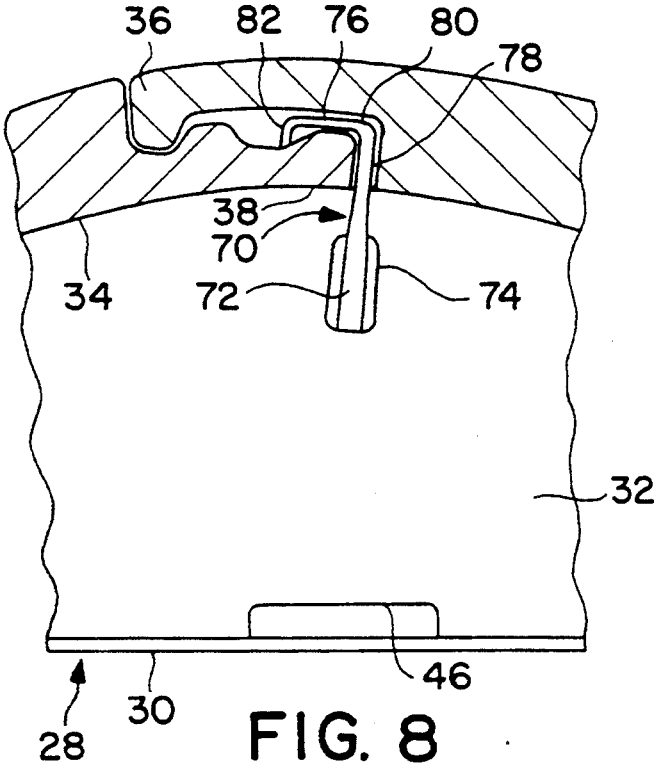
FIG. 8 is a rear view opposite the front view of FIG. 6.

As shown in FIGS. 2, 4 and 5, the upper curved lip portion 52 of the clip 50 has a neck portion 60 extending upwardly from the intermediate curved body portion 56 and terminating in an intermediate portion 62 which extends laterally from the neck portion 60. A terminal portion 64 extends downwardly from the intermediate portion 62 to complete the upper curved lip portion 52 of the clip 50. The clip 50 is of thin, planar configuration, and is twisted so that the neck portion 60 of the upper curved lip portion forms an essentially right angle relationship with the intermediate curved body portion 56.

FIG. 5 further illustrates the manner in which the clip 50 is easily installed. After the upper curved lip portion 52 of the clip 50 is secured over the left side edge 38 of the roof tile 12, the curved body portion 56 is pushed toward the upright portion 32 of the birdstop 28 as represented by an arrow 66 in FIG. 5. This causes the curved body portion 56 of the resilient clip to straighten just enough so that the lower hook portion 54 enters and hooks onto the drain slot 46. Following release of the curved body portion 56, the clip 50 is held in tension between the left side edge 38 of the roof tile 12 in the drain slot 46 of the birdstop 28.

FIGS. 6–9 depict a second embodiment of a roof tile fastening arrangement in accordance with the invention. The embodiment of FIGS. 6–9 is similar to that of FIGS. 1–5, in that a plurality of clips 70 are employed to couple the left side edges 38 of the roof tiles 12 to the birdstop 28. Unlike the embodiment of FIGS. 1–5 however, the clips 70 of the embodiment of FIGS. 6–9 each include a body portion 72 which extends through and is secured within a different one of a plurality of apertures 74 in the birdstop 28. The apertures 74 comprise a series of spaced-apart slots in the upright portion 32 of the birdstop 28 adjacent the scalloped upper edge 34.

Each of the clips 70 has an upper curved lip portion 76 configured similarly to the upper curved lip portions 52 of the clips 50. As such, the upper curved lip portion 76 includes an upwardly extending neck portion 78, an intermediate portion 80 and a terminal portion 82. This enables the upper curved lip portion 76 of the clip 70 to secure to the left side edge 38 of the roof tile 12 in the same manner as does the upper curved lip portion 52 of the clip 50. The various portions 78, 80 and 82 of the upper curved lip portion 76 are of generally flat, planar cross-sectional configuration.

Figure 9:
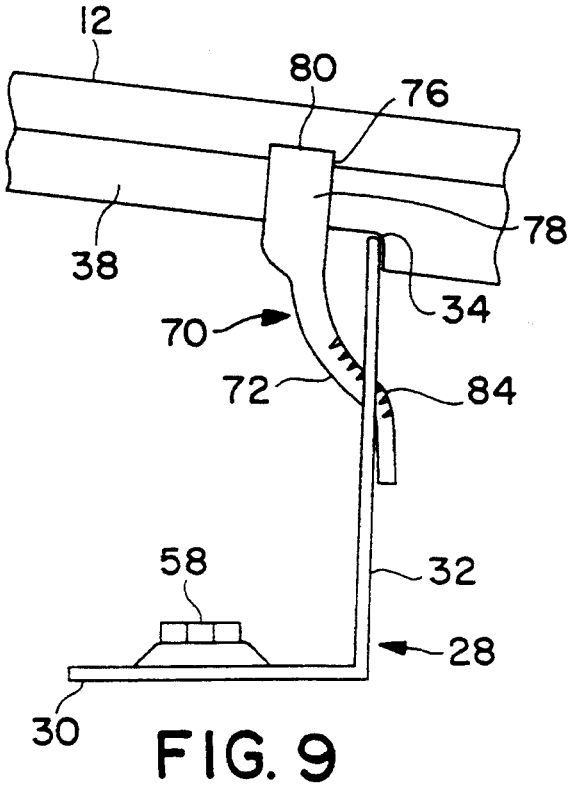
FIG. 9 is a side view of the second embodiment of FIG. 6.
Figure 10:
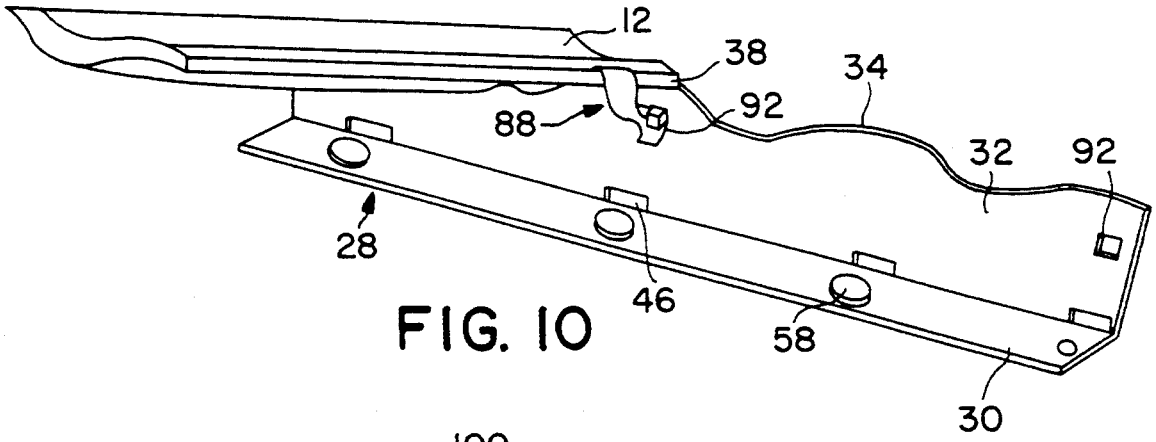
FIG. 10 is a perspective view of a portion of the roof configuration of FIG. 1 showing a third embodiment in accordance with the invention in which the clips have lower clasp portions secured within apertures in the birdstop of the roof configuration of FIG. 1.
Figure 11:
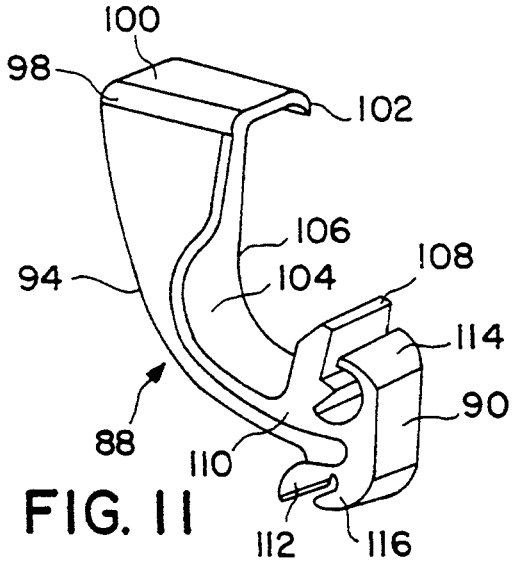
FIG. 11 is a perspective view of the clip of FIG. 10.
Figure 12:
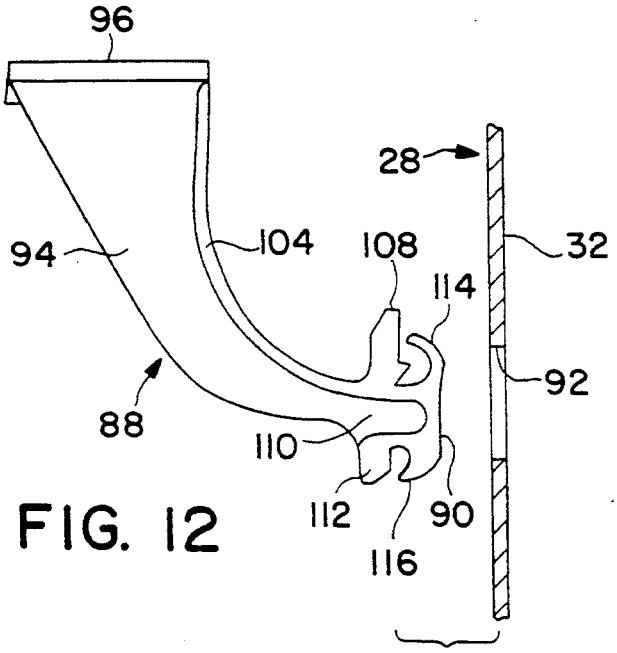
FIG. 12 is a side view of the clip of FIG. 11 disposed adjacent a portion of the birdstop having a rectangular aperture therein for receiving the lower clasp portion of the clip.

The body portion 72 of the clip 70 begins at the base of the neck portion 78. However, whereas the upper curved lip portion 76 including the neck portion 78 is of flat, planar cross-sectional configuration, the body portion 72 is of generally round cross-sectional configuration. As best shown in FIG. 9, the body portion 72 extends through a reverse curve or "S-curve" along the length thereof to facilitate insertion and retention within the aperture 74 in the birdstop 28. A surface of the body portion 72 is provided with a plurality of notches 84 therein. The notches 84 engage the walls of the aperture 74 in the birdstop 28 to help latch or secure the clip 70 in place.

The clip 70 is installed by first inserting the body portion 72 thereof into the corresponding aperture 74 in the birdstop 28. The upper curved lip portion 76 is then positioned over the left side edge 38 of the associated roof tile. With the clip 70 thus positioned, the clip 70 and the left side edge 38 of the roof tile 12 are then pushed downwardly and toward the birdstop 28 to securely seat the body portion 72 within the aperture 74 and provide a tight coupling between the left side edge 38 of the roof tile 12 and the birdstop 28.

The clips 50 and 70 of the first and second embodiments of FIGS. 1–9 can be made of metal, plastic or other appropriate materials. The clips 50 are preferably made of resilient material so as to facilitate the latching action in which the lower hook portion 54 hooks onto the drain slot 46 of the birdstop 28 during installation.

FIGS. 10–14 depict a third embodiment of a roof tile fastening arrangement in accordance with the invention. The embodiment of FIGS. 10–14 is similar to the embodiment of FIGS. 1–5 and the embodiment of FIGS. 6–9, in that a plurality of clips 88 are employed to couple the left side edges 38 of the roof tiles 12 to the birdstop 28. Unlike the embodiments of FIGS. 1–5 and 6–9, however, the clips 88 of the embodiment of FIGS. 10–14 each include a lower clasp portion 90 which is inserted and resiliently locked in position within a different one of a plurality of rectangular apertures 92 in the birdstop. The rectangular apertures 92 are located in the upright portion 32 of the birdstop 28 adjacent the scalloped upper edge 34. In the case of flat tiles rather than the profiled tiles of undulating cross-sectional configuration shown and described herein, the upper edge of the birdstop is straight, and the rectangular apertures for the clips 88 are located in appropriate positions and at an appropriate distance from the straight upper edge.

Each of the clips 88 has a curved body portion 94 which terminates in the lower clasp portion 90 at a lower end thereof and which has an upper curved lip portion 96 at an opposite upper end thereof. The upper curved lip portion 96 is configured similarly to the upper curved lip portions 52 and 76 of the clips 50 and 70 respectively. As such, the upper curved lip portion 96 includes an upwardly extending neck portion 98, an intermediate portion 100 and a terminal portion 102. This enables the upper curved lip portion 96 of the clip 88 to secure to the left side edge 38 of the roof tile 12 in the same manner as do the upper curved lip portions 52 and 76 of the clips 50 and 70. The various portions 98, 100 and 102 of the upper curved lip portion 96 are of generally flat, planar cross-sectional configuration.

The body portion 94 of the clip 88 curves through almost a right angle between the upper curved lip portion 96 and the lower clasp portion 90. The body portion 94 is of relatively thin, generally planar configuration, except for a flanged portion 104 which extends laterally therefrom at an inside edge 106 of the body portion 94. The flanged portion 104 terminates at an upper portion 108 of a base 110 of the lower clasp portion 90. The upper portion 108 of the base 110 is designed to reside against a side of the upright portion 32 of the birdstop 28 adjacent the upper edge of the rectangular aperture 92, as described hereafter. The curved body portion 94 terminates in a lower portion 112 of the base 110 opposite the upper portion 108. The lower portion 112 is designed to reside against a side surface of the upright portion 32 of the birdstop 28 adjacent the lower edge of the rectangular aperture 92, as described hereafter. The lower clasp portion 90 also includes an upper lip portion 114 disposed in spaced-apart relation relative to the upper portion 108 of the base 110, and a lower lip portion 116 disposed in spaced-apart relation relative to the lower portion 112 of the base 110. The clip 88 is made of resilient material, such as plastic, so that the upper and lower lip portions 114 and 116 are resilient in nature, as is the curved body portion 94.

Figure 13:
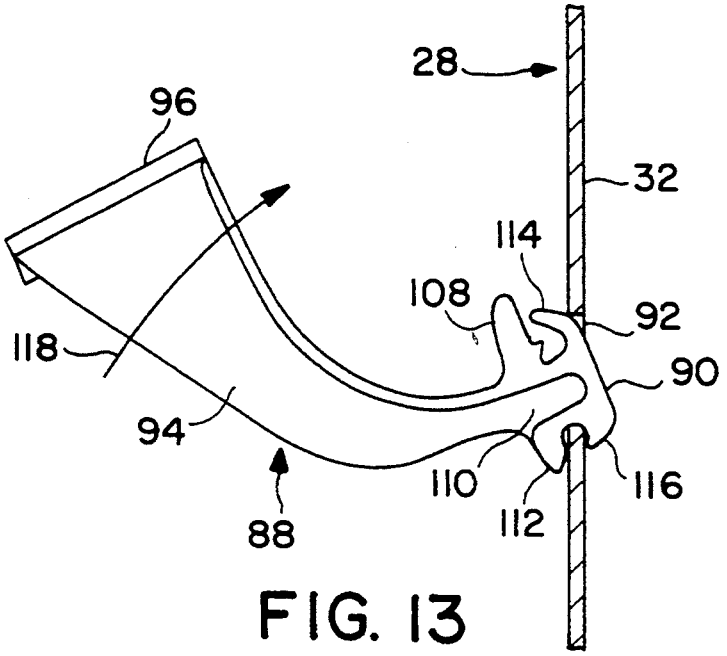
FIG. 13 is a side view of the clip of FIG. 11 showing the manner in which insertion of the lower clasp portion thereof into the rectangular aperture in the birdstop is initiated.
Figure 14:
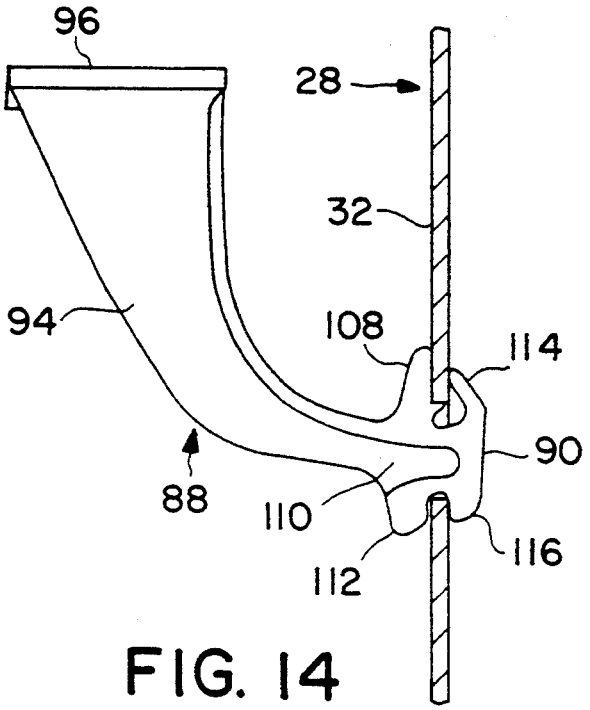
FIG. 14 is a side view of the clip of FIG. 11 showing the manner in which seating and locking of the lower clasp portion of the clip within the rectangular aperture in the birdstop is completed.

The manner in which the lower clasp portion 90 of the clip 88 is installed in the rectangular aperture 92 is illustrated in FIGS. 13 and 14. Initially, the clip 88 is tilted so that the lower lip portion 116 is disposed over the lower edge of the rectangular aperture 92, with the lower portion 112 of the base 110 disposed against the side of the birdstop 28 at the lower edge of the rectangular aperture 92. In this position of the clip 88, the upper lip portion 114 resides against the upper edge of the rectangular aperture 92. The clip 88 is then rotated in an upward direction as represented by an arrow 118 in FIG. 13. Because of the resilient nature of the upper lip portion 114, such movement of the clip 88 forces the upper lip portion 114 downwardly so as to enable such upper lip portion 114 to pass along the upper edge of the rectangular aperture 92 until the upper portion 108 of the base 110 becomes seated against the surface of the upright portion 32 of the birdstop 28. As the upper lip portion 114 clears the upper edge of the rectangular aperture 92, such upper lip portion 114 snaps into place against the opposite surface of the upright portion 32 of the birdstop 28 adjacent the upper edge of the rectangular aperture 92. The upper and lower lip portions 114 and 116 bear against the side surface of the upright portion 32 of the birdstop 28 adjacent the upper and lower edges of the rectangular aperture 92, against the resistance of the upper and lower portions 108 and 112 of the base 110, to resiliently lock and hold the lower clasp portion 90 in place within the rectangular aperture 92.

With the lower clasp portion 90 of the clip 88 resiliently seated and locked within the rectangular aperture 92 in the upright portion 32 of the birdstop 28, in the manner just described, the resilient nature of the clip 88 including the curved body portion 94 thereof permits continued upward movement of the body portion 94 so as to enable the upper curved lip portion 96 to be hooked over the left side edge 38 of the concrete roof tile 12. Upon release of the clip 88, the resilient nature of the clip 88 causes it to be held in tension between the left side edge 38 of the roof tile 12 and the upright portion 32 of the birdstop 28.

While the invention has been particularly shown and described with reference to preferred embodiments thereof, it will be understood by those skilled in the art that various changes in form and details may be made therein without departing from the spirit and scope of the invention.

What is claimed is:

1. A roof tile fastening arrangement comprising the combination of:

a roof support structure having a lower edge;

a facia member mounted on the roof support structure adjacent the lower edge thereof;

a plurality of tiles mounted side-by-side on the roof support structure and disposed on the facia member, each of the plurality of tiles having a pair of opposite side edges adjacent side edges of adjacent tiles;

a plurality of clips, each extending between and coupled to the facia member and to one of the pair of opposite side edges of one of the plurality of tiles; and the facia member comprising a birdstop having a plurality of apertures therein and each of the clips having a lower clasp portion resiliently locked within one of the plurality of apertures in the birdstop.

2. The invention set forth in claim 1, wherein the lower clasp portion of each of the clips has a base disposed against one side of the birdstop at the one of the plurality of apertures and opposite upper and lower lip portions resiliently disposed against an opposite side of the birdstop at the one of the plurality of apertures.

3. A roof tile clip having an upper curved lip portion for engaging a side edge of a tile, an opposite lower clasp portion for resiliently locking within an aperture in a roof structure, and an intermediate body portion which is curved through substantially a right angle between the upper curved lip portion and the lower clasp portion, the lower clasp portion having a pair of oppositely extending flanges and a pair of lip portions, at least one of the lip portions being resilient, and the pair of lip portions being disposed adjacent and spaced-apart from the pair of oppositely extending flanges.

4. The invention set forth in claim 3, wherein the clip is made of resiliently flexible material.

5. A roof tile clip having an upper curved lip portion for engaging a side edge of a tile, an opposite lower clasp portion for resiliently locking within an aperture in a roof structure, and an intermediate body portion, the lower clasp portion including a base at a lower end of the intermediate body portion, the base having oppositely extending upper and lower flanges and resilient upper and lower lip portions disposed adjacent and spaced-apart from the upper and lower flanges respectively.

6. The invention set forth in claim 5, wherein the intermediate body portion is curved through at least a substantial portion of a right angle around an inside edge, the inside edge having a flanged portion extending laterally from opposite sides of the intermediate body portion and terminating at the upper flange of the base.

7. The invention set forth in claim 5, wherein the upper and lower lip portions are resiliently flexible relative to the upper and lower flanges in order to resiliently receive portions of a facia member on opposite sides of an aperture in the facia member between the upper and lower lip portions and the adjacent upper and lower flanges.

* * * * *